US005131718A

United States Patent [19]

Cooper

[11] Patent Number: 5,131,718

[45] Date of Patent: Jul. 21, 1992

[54] ADJUSTABLE CHAIR

[75] Inventor: Jack Cooper, Woodbridge, Canada

[73] Assignee: Flux Enterprises Incorporated, Woodbridge, Canada

[21] Appl. No.: 648,813

[22] Filed: Jan. 31, 1991

[51] Int. Cl.[5] ..... A47C 1/06

[52] U.S. Cl. ..... 297/344; 297/349; 248/416

[58] Field of Search ..... 297/349, 344; 248/416, 248/418, 425

[56] References Cited

U.S. PATENT DOCUMENTS

| | | | |
|---|---|---|---|
| 2,312,030 | 2/1943 | Cramer et al. | 248/418 X |
| 3,542,326 | 11/1970 | Reapsummer | 248/416 X |
| 3,659,895 | 5/1970 | Dresden | 248/416 X |

*Primary Examiner*—Kenneth J. Dorner

*Assistant Examiner*—Milton Nelson, Jr.

*Attorney, Agent, or Firm*—Spencer, Frank & Schneider

[57] ABSTRACT

A chair is provided with a seat which is rotatable and translatable with respect to its pedestal. Specifically, the chair includes a support pinion on top of the pedestal and a bearing surface mounted on the underside of the seat. The pinion has bearings on its upper surface which contact the bearing surface to support the seat. The seat also has a pair of racks mounted on it, the racks including recesses which interlock with complementary bosses on the support pinion to inhibit movement of the seat with respect to the pedestal. A pair of grips are attached, one to each rack, such that lifting either grip disengages both racks from the pinion allowing the seat to translate and rotate via the bearings on the support pinion and the bearing surface.

15 Claims, 7 Drawing Sheets

ADJUSTABLE CHAIR

BACKGROUND OF THE INVENTION

The present invention relates to an improved chair with a seat which is independently rotatable and translatable with respect to its pedestal.

It is well known in the art of chair construction to allow the seat of a chair to rotate with respect to its pedestal. It is also known to provide a seat which may be translated with respect to its pedestal. Prior art chairs with rotating seats include stools such as for example, those used at counters in restaurants or bars, and office chairs. Prior art chairs with seats which are translatable include automobile and truck seats.

In many situations, such as for use with physically challenged individuals or in confined locations, it is desirable to provide a chair with a seat which is both rotatable and translatable and which is easy to operate.

Previous attempts have been made to construct chairs with seats which are both rotatable and translatable. U.S. Pat. No. 3,542,326 shows a slide mechanism for an adjustable chair. The slide mechanism, which is rotatably mounted on the pedestal of the chair, allows the seat of the chair to translate with respect the pedestal.

U.S. Pat. No. 2,290,464 shows a mechanism which allows the translation and rotation of seats in motor vehicles. Specifically, the seat is mounted on rails and a gear and toothed track operate to rotate the seat through ninety degrees as it is translated between the extremes of the track. This facilitates entry to and exit from the vehicle.

U.S. Pat. No. 2,409,114 shows another mechanism allowing the translation and rotation of the seat of a chair. The mechanism features an interlock whereby the seat may be rotated up to 90 degrees from the forward direction only when the seat is at one extreme of its range of translation. The interlock also operates to inhibit translation of the seat when the seat is rotated from a forward facing orientation.

Problems and disadvantages exist with the prior art proposals. In some prior proposals, the rotation and translation operations cannot be independently accomplished. Where the rotation and translation operations are capable of being independently performed, separate mechanisms are required to inhibit each of the rotation and translation operations. These mechanisms are often difficult to operate by physically challenged individuals, are expensive to construct due to the increased number of components and are often not compact, rendering them impractical for many potential applications.

It is therefore an object of the present invention to provide a novel chair which obviates or mitigates these difficulties.

SUMMARY OF THE INVENTION

According to one aspect of the present invention, there is provided a chair comprising:

a seat;

support means supporting said seat in a manner to allow independent translation and rotation of said seat with respect to said support means;

locking means operable between said support means and said seat to inhibit said translation and rotation of said seat with respect to said support means; and release means operable to disengage said locking means.

Preferably, the locking means is biased to a condition to inhibit movement of the seat with respect to the support means and the release means operates against the bias to disengage the locking means.

It is also preferred that the support means is in the form of a pedestal to elevate the seat with respect to the ground and that the locking means is in the form of a pinion fixed to the pedestal of the chair and a pair of racks fixed to the seat, the racks having recesses complementary to bosses on the pinion and engaging therewith to inhibit the rotation and translation of the seat with respect to the pedestal.

Preferably, the release means includes a pair of release grips located at opposite sides of the seat, the movement of either grip causing both racks to disengage from the pinion bosses, thus allowing the seat to be translated and rotated.

It is also preferred that the support means includes bearings to facilitate translation and rotation of the seat with respect to the pedestal.

The present invention provides advantages over the prior art in that it permits the simultaneous or independent rotation and translation of the seat with respect to the pedestal through a single locking device which is easy to operate. The present invention provides a further advantage over the prior art in that it is relatively compact.

A preferred embodiment of the present invention will now be described, by way of example only, with reference to the following figures wherein:

DESCRIPTION OF THE PREFERRED EMBODIMENT

Figure 1:
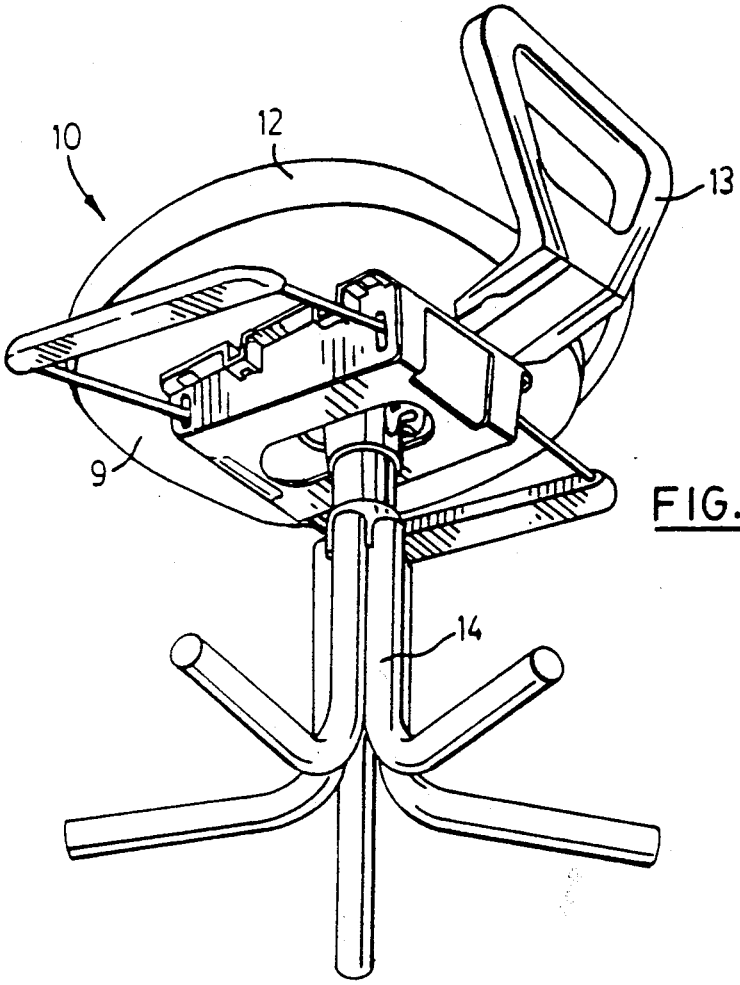
FIG. 1 is a perspective view of a chair taken from below and from the side and showing a chair joint mechanism.
Figure 2:
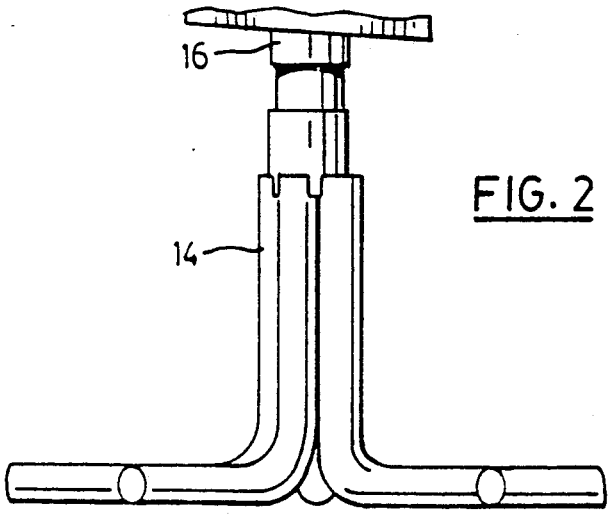
FIG. 2 is a side view of a portion of the chair joint mechanism of FIG. 1 in place on a chair pedestal.
Figure 3:
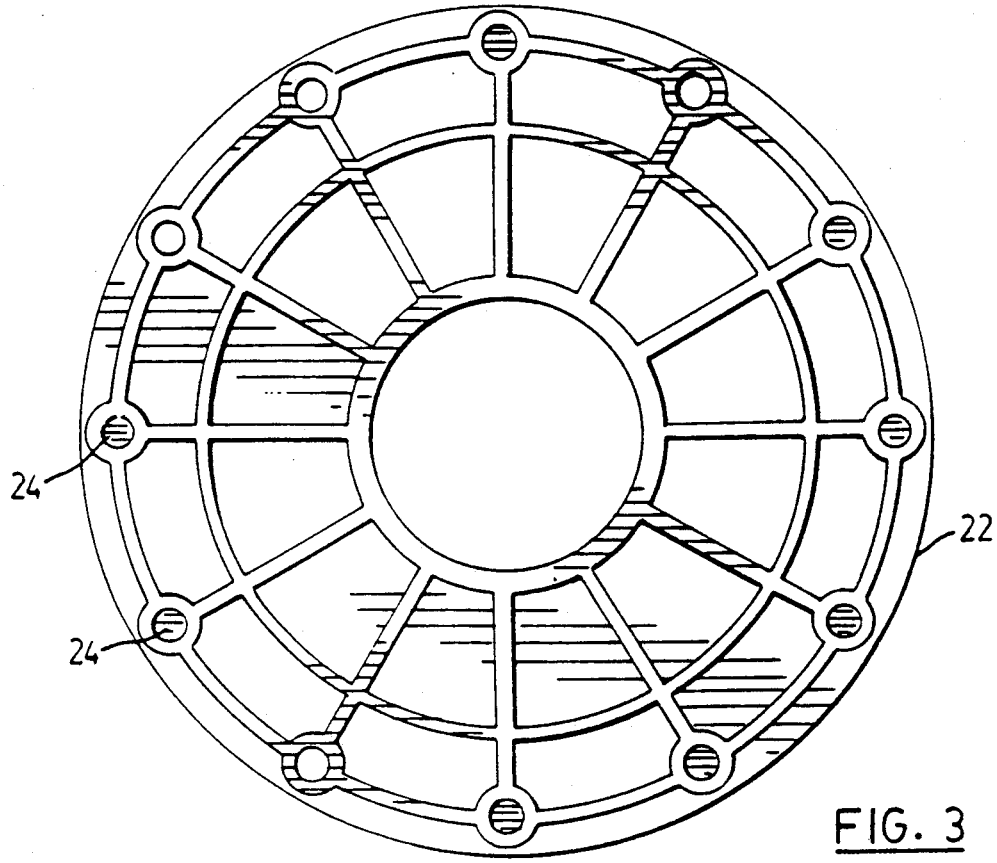
FIG. 3 is a top view of a support pinion in the chair joint mechanism of FIGS. 1 and 2.
Figure 4:
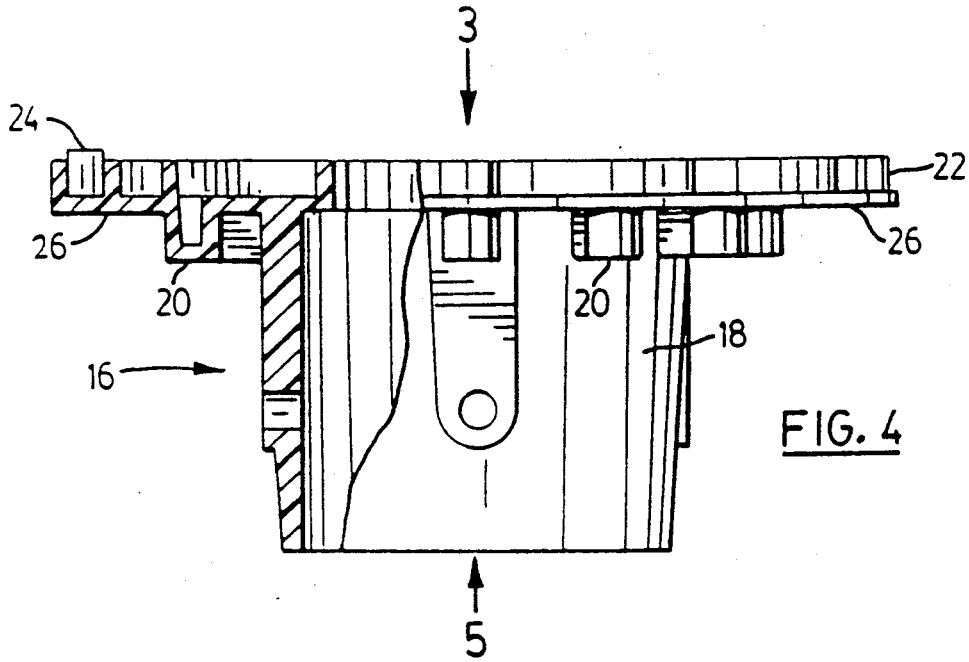
FIG. 4 is a side view in cut away of the support pinion of FIG. 3.
Figure 5:
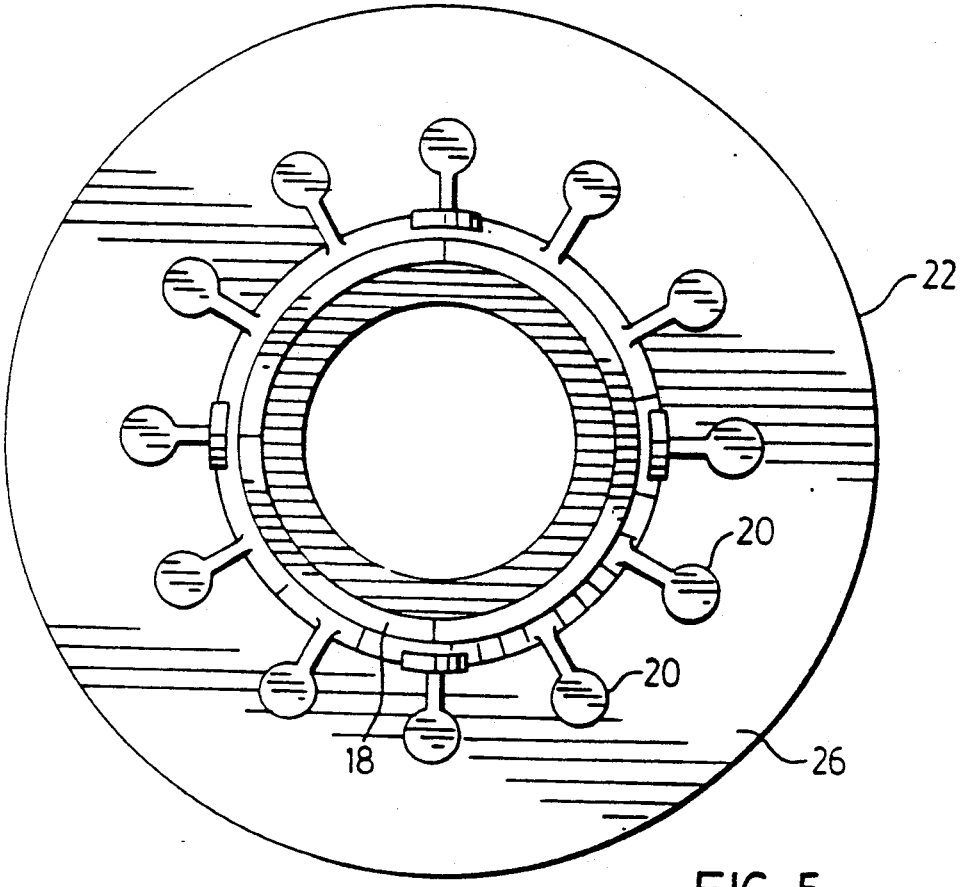
FIG. 5 is a bottom view of the support pinion of FIG. 3.

FIG. 1 shows a chair 10 embodying the present invention. The chair 10 includes a seat 12 which is supported above a surface by a pedestal 14. The seat also includes a backrest 13 and may include armrests. A mechanism 9, as will be described below, is mounted to the seat 12 and allows the seat 12 to be translated and rotated with respect to the pedestal 14.

Referring now to FIGS. 2, 3, 4 and 5, a support pinion 16 is shown mounted on the pedestal 14. The support pinion 16 has a collar 18, which is sized to receive the pedestal, and a circular annular flange 22. The upper surface of the flange 22 has bearings 24 spaced equally about its periphery. The bearings 24 are inserts which are formed from a suitable compound such as a mixture of Delrin® (a trademark for E. I. duPont de Nemours & Co. Inc. (DuPont resin) and Teflon® (a trademark for DuPont polytetrafluoroethylene) and protrude above the surface of the flange 22. On its lower surface, the flange 22 has an annular bearing surface 26 located around its perimeter and a depending circular array of bosses 20.

Figure 6:
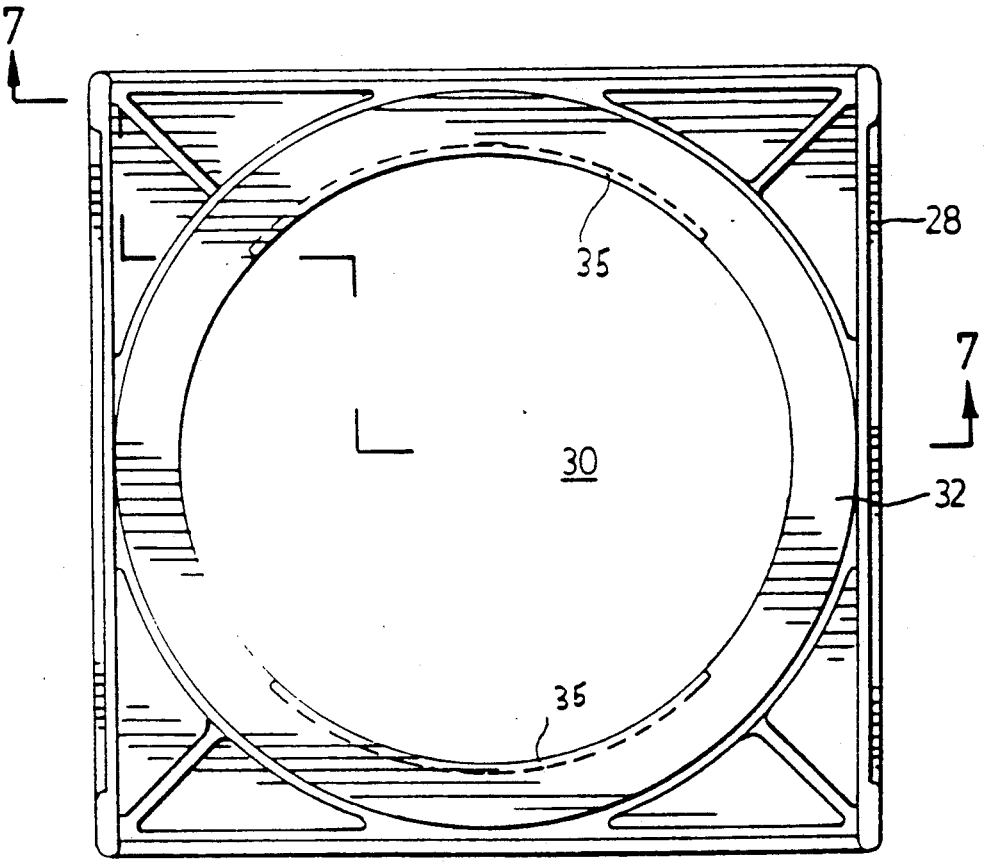
FIG. 6 is a top view of a slider plate.
Figure 7:
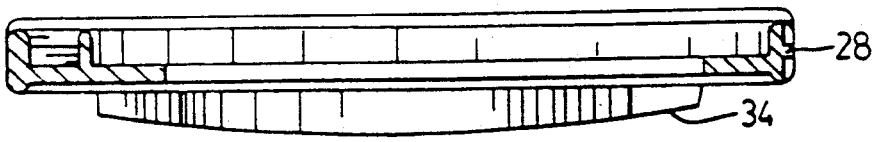
FIG. 7 is a section of the slider plate of FIG. 6 along line 7—7.

FIGS. 6 and 7 show a slider plate 28. The plate has a circular hole 30 at its center and a circular bearing surface 32 which is located in the upper surface of the plate 28 about the periphery of the hole 30. The plate 28 further includes two pairs of ribs which depend below plate 28, the first pair 34 being located at opposite edges of the plate and the second pair 35 being located on opposite sides of hole 30. Both pairs of ribs 34,35 increase the stiffness of the plate.

Support pinion 16 is assembled with plate 28 such that the annular bearing surface 26 of the support pinion overlies the bearing surface 32 with collar 18 and the array of bosses 20 depending below the plate 28. The material of the plate 28 is selected from a suitable substance such as Delrin® to allow the rotation of flange 22 within the plate 28. The thickness of plate 28 and the arrangement of bearing surface 32 are selected such that when support pinion 16 is assembled with the plate 28, the bearings 24 of the flange 22 extend above the plate surface.

Figure 8:
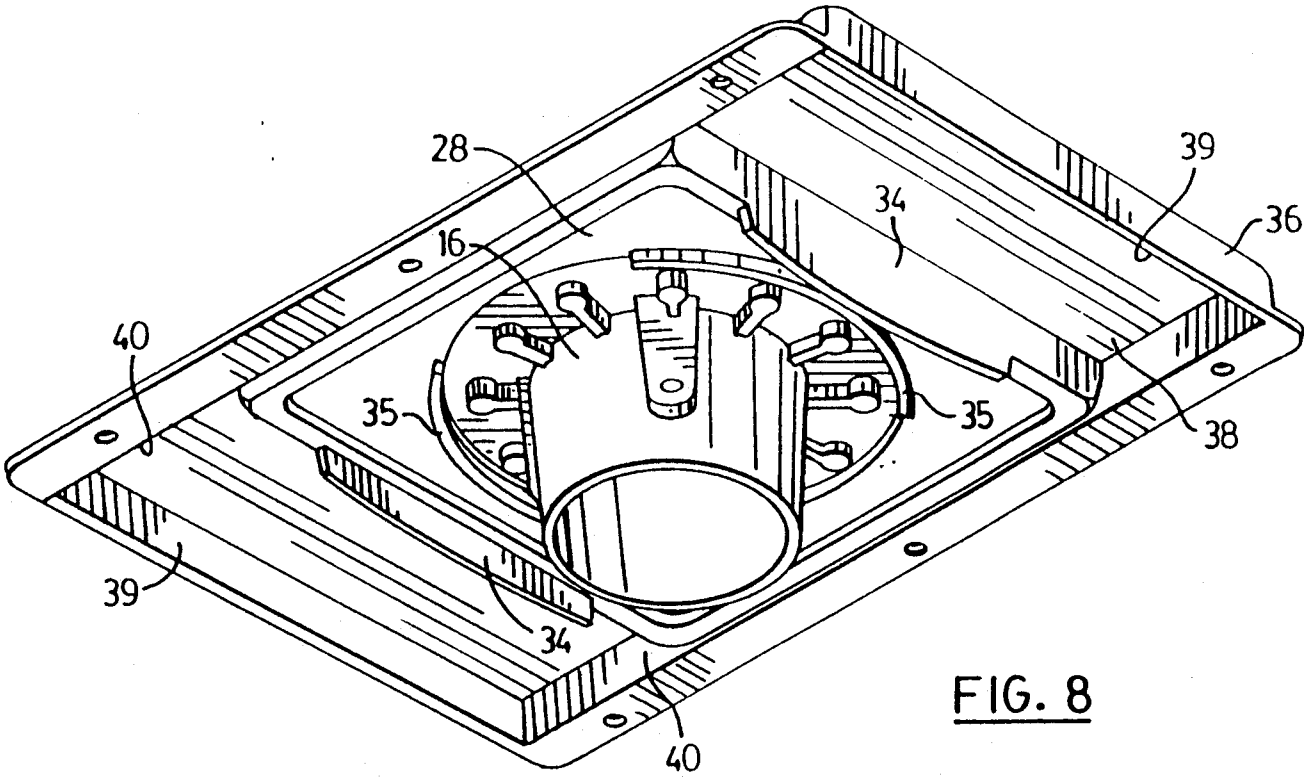
FIG. 8 is a view of part of the chair joint mechanism.

FIG. 8 shows the assembly of the slider plate 28 and support pinion 16 in a slider tray 36. The slider tray 36 is bounded by end walls 39 and side walls 40 which form a flat rectangular recess 38. When the slider plate 28 and support pinion 16 are assembled as shown, the bearings 24 are in sliding contact with the recess 38 and the pinion 16 and plate 28 are translatable along the recess 38. As stated before, the pinion 16 is rotatable within plate 28, and thus with respect to slider tray 36, with the bearings 24 also being in contact with the surface of recess 38.

Figure 9:
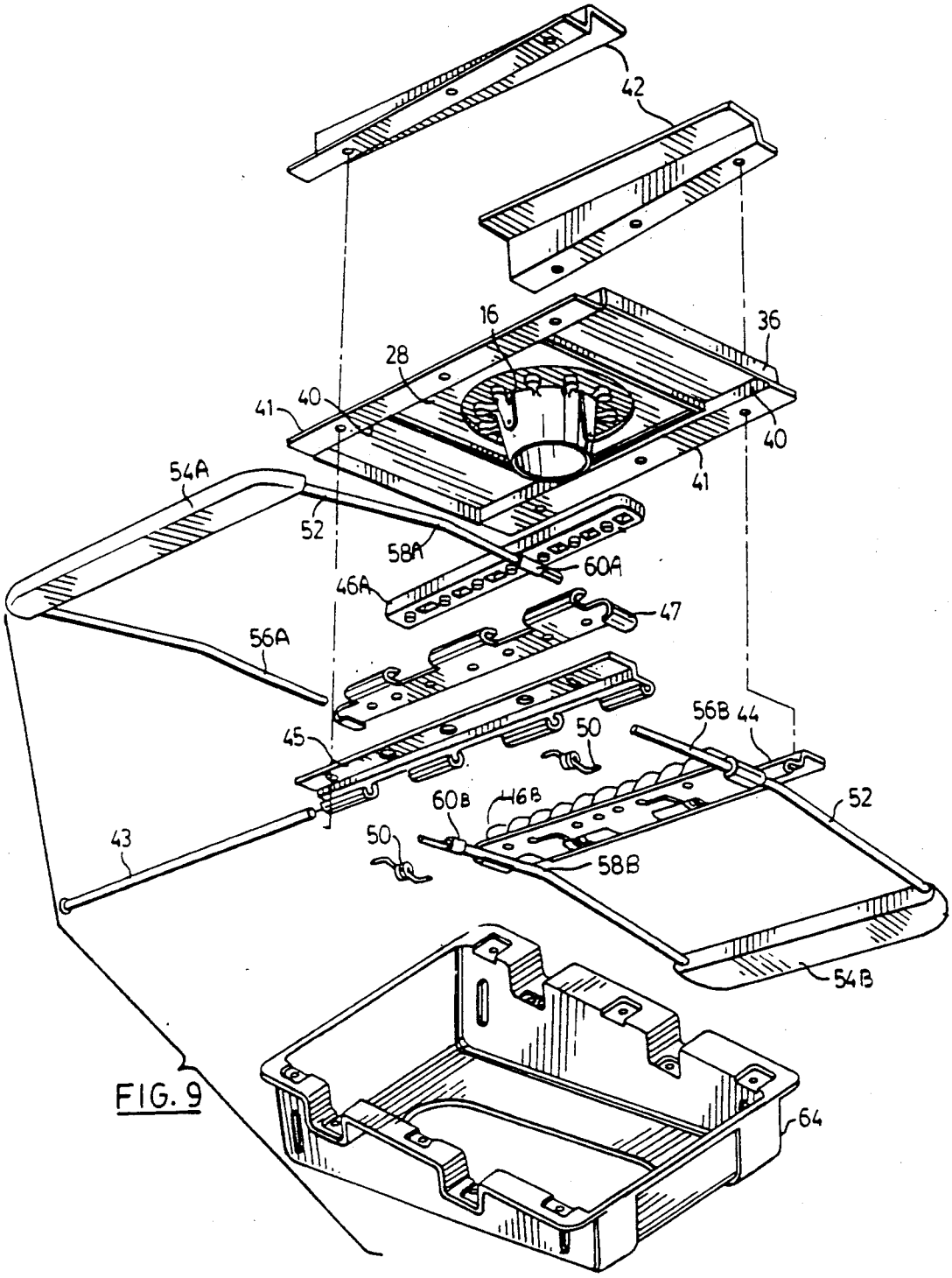
FIG. 9 is an exploded view of the chair joint mechanism.

FIG. 9 shows an exploded view of components of the chair mechanism. The assembly of the slider tray 36, support pinion 16 and plate 28 is attached either directly, or through adapter rails 42, to the chair seat.

The side walls 40 of slider tray 36 have flanges 41 along their length to which hinge assemblies 44 are fastened. The hinge assemblies 44 comprise two plates 45,47 which are pivotally connected by pin 43. When attached to the flange 41, a portion of plate 45 of each hinge assembly 44 overhangs recess 38 to form a channel for slider plate 28. The range of movement of slider plate 28 is thus limited to movement along recess 38.

Figure 10:
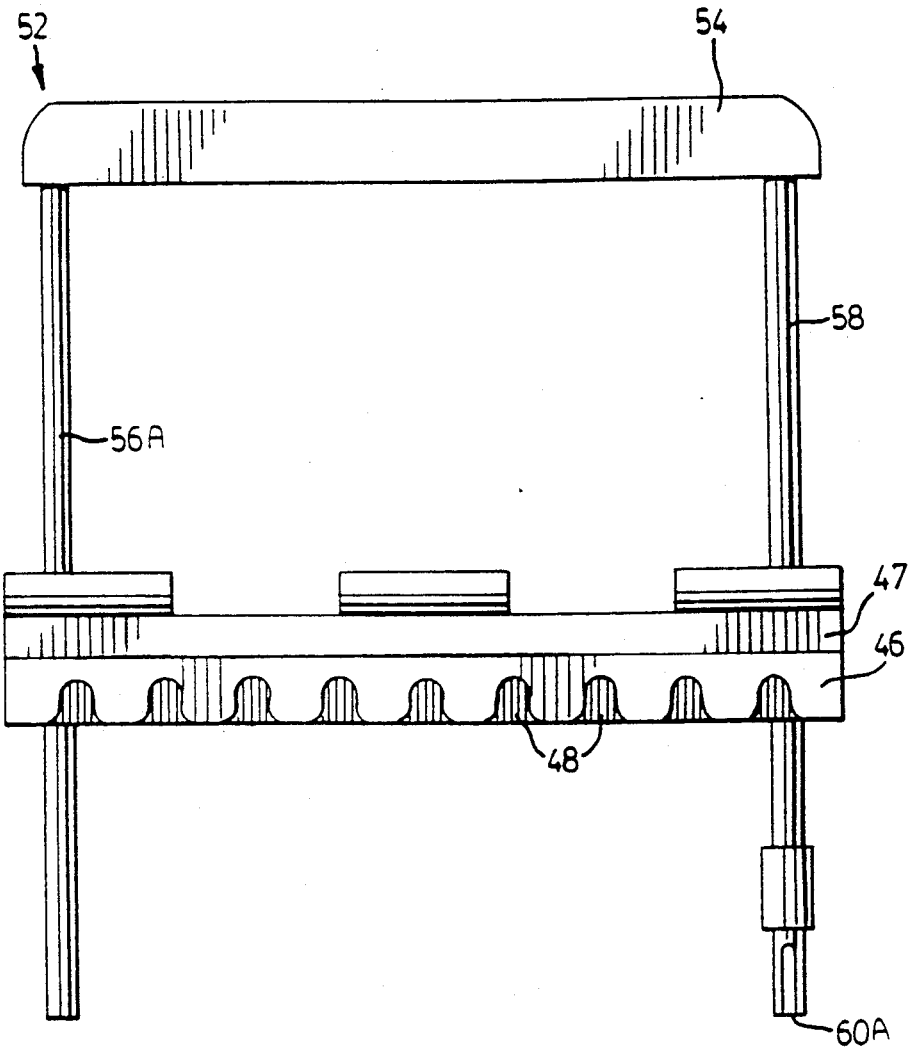
FIG. 10 is a top view of a hinge and grip assembly.
Figure 11:
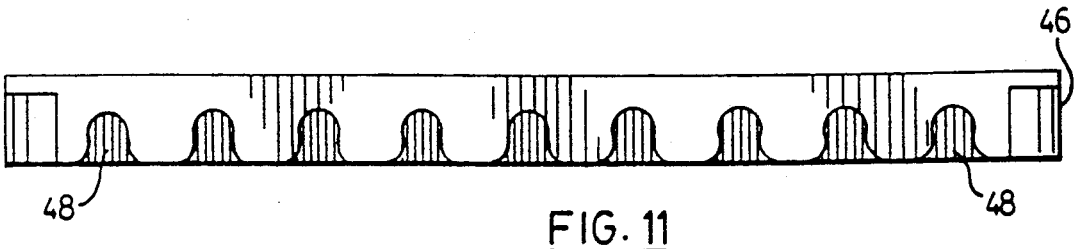
FIG. 11 is a top view of a rack.

Each hinge assembly 44 also has mounted to its other plate 47 a rack 46 as shown in FIG. 10. Each rack 46 has recesses 48, best shown in FIG. 11, which are shaped in a complementary manner to receive bosses 20 of pinion 16 and the edges of recesses 48 are chamfered.

The hinge assemblies 44 further include helical springs 50 which bias plate 47 into a position overlying the support pinion 16. The racks 46 are arranged on the hinge plates 47 such that when the assemblies 44 are overlying the pinion 16, the recesses 48 in each of racks 46 engage one or more of bosses 20. This engagement inhibits the rotation of the support pinion 16 within plate 28 and also inhibits the sliding of the plate 28 within the recess 38.

A release handle 52 is attached to the plate 47 of each hinge assembly 44. The handle 52 has a grip 54 and two rigid arms 56,58 which are affixed to hinge plate 47. At the end of arm 58 is a channel member 60 which is sized to receive the end of arm 56. The arms 56,58 are affixed to the plate 47 such that their ends extend beyond the hinge assembly 44 and overlap with the arms of the other handle 52. At the overlap point, channel 60A receives the end of arm 56B and in a similar manner, channel 60B receives the end of arm 56A.

When assembled, the chair joint mechanism may favourably be enclosed by a cover 64 for aesthetic and safety reasons.

In operation, when a grip 54A is lifted, the hinge assembly 44A, to which it is attached, pivots plate 47 from its position overlying the pinion 16, thus moving rack 46A out of contact with bosses 20. Furthermore, when grip 54A is lifted, the channel 60A associated with the arm 58A cooperates with the end of arm 56B of to ensure that both hinge assemblies 44 are pivoted form their overlying positions. Thus, a user need only lift one grip 54A,54B to move both racks 46A,46B out of engagement with the bosses 20.

When the racks 46 are disengaged from the bosses 20, the support pinion 16, and hence slider plate 28, are free to slide along the recess 38. Also support pinion 16 is free to rotate within slider plate 28. Thus, the seat may be translated and/or rotated as desired.

When the seat is in the desired position, the user releases the grip 54 and the racks 46 are again biased into contact with bosses 20 by helical springs 50. Two situations may occur at this point, the recesses 48 may be aligned with and engage one or more of the bosses 20 or the bosses 20 may be mis-aligned with the recesses 48 in racks 46.

In the latter case, the racks 46 remain biased against the bosses 20 by the springs 50 and when the seat is moved a small amount, either intentionally or through the course of normal use, and the bosses 20 align with the recesses 48 which engage one or more of the bosses 20, thus locking the seat in place. The alignment of the bosses 20 with the recesses 48 is facilitated by the chamfering of the edges of the recesses 48 in racks 46.

We claim:

1. A chair comprising:

a seat;

support means disposed adjacent said seat for supporting said seat in a manner to allow translation and rotation of said seat with respect to said support means;

locking means disposed adjacent said support means for acting between said seat and said support means, said locking means being movable between a released position in which said seat is freed to permit simultaneous rotational and translational movement of said seat with respect to said support means and an engaged position in which said seat is locked against such rotational and translational movement;

biasing means disposed adjacent said locking means for biasing said locking means toward said engaged position; and a single release means disposed adjacent said locking means for moving said locking means between said engaged and release positions.

2. A chair according to claim 1 wherein said locking means comprises first and second interlocking members, said first interlocking member being mounted on said support means and said second interlocking member being mounted on said seat; said single release means operating to bring said interlocking members out of engagement.

3. A chair according to claim 2 wherein said first interlocking member comprises a pinion with an array of bosses; and said second interlocking member comprises a pair of hinged racks, said racks having recesses complementary to said bosses.

4. A chair according to claim 3 wherein said support means includes a pedestal upon which said pinion is mounted.

5. A chair according to claim 4 wherein said recesses include chamfered edges.

6. A chair according to claim 4 wherein said release means comprises two handles, each handle being connected to a different rack and being operable with the other said handle such that movement of either said handle disengages both said racks from said bosses.

7. A chair according to claim 4 wherein said support means includes bearing means mounted on said pinion to facilitate the rotation and translation of said seat with respect to said pedestal.

8. A chair according to claim 4 wherein said support means includes a tray mounted on said seat to receive said pinion.

9. A chair according to claim 8 wherein said support means further includes a plate slidably mounted within said tray, said plate being adapted to receive said pinion and to facilitate the rotation thereof with respect to said tray.

10. A kit for converting a chair having a seat and a pedestal to allow the translation and rotation of said seat with respect to said pedestal, the kit comprising:

support means including first and second interlocking members, said first interlocking member being adapted for mounting on said pedestal and said second interlocking member being adapted for mounting on said seat, said support means acting between said seat and said pedestal in a manner to allow simultaneous translational and rotational movement of said seat with respect to said pedestal;

biasing means for moving said interlocking members into an engaged position in which the translational and rotational movement is inhibited; and a single release means for operating against said biasing means to move said first and second interlocking members into a released position in which said seat is freed to permit said rotational and translational movement.

11. A kit according to claim 10 wherein said first interlocking member comprises a pinion with an array of bosses; said second interlocking member comprises a pair of racks, said racks having recesses complementary to said bosses.

12. A kit according to claim 11 wherein said release means comprises two handles, each said handle being connected to a different rack and being operable with the other said handle such that movement of either said handle moves both said racks out of engagement with said pinion.

13. A kit according to claim 12 wherein said support means further includes bearing means mounted on said pinion to facilitate the rotation and translation of said seat with respect to said pedestal.

14. A kit according to claim 13 wherein said support means also includes a tray mounted on said seat to receive said pinion.

15. A kit according to claim 14 wherein said support means further includes a plate slidably mounted within said tray, said plate being adapted to receive said pinion and to facilitate the rotation thereof with respect to said tray.

* * * * *